US007260975B2

(12) United States Patent
Hamm et al.

(10) Patent No.: US 7,260,975 B2
(45) Date of Patent: Aug. 28, 2007

(54) COMPRESSION TOOL JAWSET

(75) Inventors: James E. Hamm, Grafton, OH (US); Todd A. Westley, Elyria, OH (US)

(73) Assignee: Emerson Electric Co., St. Louis, MO (US)

( * ) Notice: Subject to any disclaimer, the term of this patent is extended or adjusted under 35 U.S.C. 154(b) by 200 days.

(21) Appl. No.: 11/059,116

(22) Filed: Feb. 16, 2005

(65) Prior Publication Data

US 2006/0179912 A1 Aug. 17, 2006

(51) Int. Cl.
*B21D 37/00* (2006.01)
*B21D 37/20* (2006.01)

(52) U.S. Cl. ..... 72/416

(58) Field of Classification Search ..... 72/416, 72/409.01, 453.16, 407, 453.15; 29/237, 29/751; 81/349, 416, 417, 427
See application file for complete search history.

(56) References Cited

U.S. PATENT DOCUMENTS

| | | | | |
|---|---|---|---|---|
| 3,051,028 | A * | 8/1962 | Kreger | 81/351 |
| 3,554,000 | A * | 1/1971 | Schwab | 72/453.15 |
| 5,299,416 | A * | 4/1994 | Wu | 59/85 |
| 6,434,998 | B2 | 8/2002 | Amherd | |
| 7,000,448 | B2 * | 2/2006 | Hamm et al. | 72/409.01 |
| 2001/0013243 | A1 | 8/2001 | Amherd | |
| 2004/0154371 | A1 | 8/2004 | Hamm et al. | |

FOREIGN PATENT DOCUMENTS

| | | | |
|---|---|---|---|
| CH | 687 368 | A5 | 11/1996 |
| DE | G 93 14 054.1 | U1 | 9/1993 |
| DE | 299 08 622 | U1 | 7/1999 |
| DE | 103 26 624 | A1 | 3/2004 |
| EP | 1 447 179 | A2 | 8/2004 |
| WO | WO 02/39872 | A1 | 5/2002 |

OTHER PUBLICATIONS

PCT International Search Report (4 pgs.).
PCT Written Opinion of the International Searching Authority- Int'l. App. No. PCT/US2006/005452 (8 pgs.).

* cited by examiner

*Primary Examiner*—Daniel C Crane
(74) *Attorney, Agent, or Firm*—Fay Sharpe LLP

(57) ABSTRACT

A compression tool having a pair of jaw arms pivotal between side plates and having inner edges provided with laterally inwardly open opposed spring pin recesses providing an opening therebetween for a spring pin, and a spring associated with the pin and biasing the jaw arms in a closing direction and biasing the spring pin rearwardly of the spring pin opening has one or the other or both the spring pin opening and spring pin modified for the pin to be displaced from the spring pin opening or canted therein in response to a fracture of at least one of the jaw arms outwardly from the corresponding pin recess toward the outer edge of the jaw arm.

36 Claims, 6 Drawing Sheets

COMPRESSION TOOL JAWSET

BACKGROUND OF THE INVENTION

This invention relates to the art of compression tools for joining pipes and couplings and, more particularly, to improvements by which a failure of one or both pivotal jawarm members of a compression jawset is indicated to a user thereof.

A compression tool of the character to which the present invention relates is shown in U.S. Pat. No. 6,434,998 to Amherd. Such tools include a compression jawset removably mounted on a drive mechanism by which the jawarms of the set are displaced into compression about a pipe and coupling to join the latter. The jawset is comprised of a pair of jawarm members pivotally mounted between a pair of side plates and having laterally inwardly open opposed jaw recesses at one end and laterally inwardly facing cam surfaces at the opposite ends. The jawarms are pivotal about pins located in openings through the jawarms between the opposite ends thereof, and the jawarm members have laterally inner and outer edges between the opposite ends thereof. The inner edges of the jawarms have inwardly open opposed spring pin and spring recesses which accommodate a spring pin and a spring extending across the forward end of the pin and having legs extending rearwardly along the inner surface of the corresponding jawarm, whereby the jawarms are biased toward the closing direction relative to workpieces to be joined together. The jawset is mountable on the drive mechanism by means of the side plates and at a location relative to the jawset which is laterally between the pivot pins and cam surfaces of the jawarms. The drive mechanism includes cam rollers which are displaceable axially forwardly and rearwardly along the cam surfaces of the jawarms, and when displaced forwardly of the cam surfaces, the cams engage the latter and displace the opposed jaw recesses toward one another and constrictably about a pipe and coupling interposed therebetween. During operation of the jawset to compressibly join a pipe and coupling, the area of each of the jawarm members between the pivot pin opening and inner edge thereof and along the inner edge between the jaw recess and cam surface thereof is under tension, and the area of the jaw arm laterally outwardly of the pivot pin opening is under compression. The side plates are also stressed during operation of the jawset in that pivotal displacement of the jawarm members about the pivot pins to produce compressive engagement between the jaw recesses imposes laterally outwardly directed forces through the pivot pins to the side plates.

At some point during the life of the jawset, failure will occur. Such failure may be in a side plate of the jawset or in a jawarm member. With respect to failure in a jawarm member, the latter is initiated by a fatigue crack at a location along the inner edge thereof and fracture of the jawarm from the fatigue crack toward the outer edge thereof. In the absence of intentionally designed structures for controlling the location of the fatigue crack and the direction of the fracture therefrom, as shown for example in co-pending patent application Ser. No. 10/364,008 filed Feb. 12, 2003 and assigned to the same assignee as the present application, the disclosure of which is incorporated herein for background information, the location of the fatigue crack and direction of the fracture is unpredictable. In testing 38 jawarm members of different sizes and of the structure shown in the patent to Amherd, it was noted that a majority of the jawarms of each size either failed from the spring pin recess to the pivot pin opening through the jawarm or from the spring pin recess across the jawarm towards the outer edge thereof. Moreover, such failures outwardly of the spring pin opening are not visible to a user of the compression tool in that the spring pin and pin recesses and areas of the jaw arm outwardly thereof are covered by the side plates of the jawset. Accordingly, by the time a user of the compression tool becomes aware of such failure, a number of unacceptable, oversized crimps can be made, and the replacement thereof is unnecessarily time-consuming and expensive. The pin spring biases the pin rearwardly of the pin opening defined by the opposed pin recesses, and deformation of the jawarm following a fracture will be such that the recesses will spread apart sufficiently for the spring to eject the pin from the pin opening. While this visually indicates a failure to the user of the compression tool, such deformation to the extent necessary for ejection of the pin is preceded by the making of a number of unacceptable, oversized crimps.

SUMMARY OF THE INVENTION

In accordance with the present invention, one or the other or both of the spring pin opening and spring pin are modified such that, following a fracture outwardly from the spring pin opening, and prior to the making of unacceptable, oversize crimps, either the spring pin will be ejected from the opening by the spring or the position of the spring pin in the opening is canted relative thereto so as to jam relative displacement of the jawarms in the direction to open the jaw recesses. The occurrence of either of these events provides an immediate indication of failure to the operator of the compression tool. The modification or modifications are based on an acceptable amount of relative deformation between the jawarms prior to a fracture reaching a point spaced outwardly from the pin opening and beyond which the deformation would be such as to cause unacceptable, oversized crimps to be made.

In accordance with one aspect of the invention, the spring pin opening is modified by, removing material from the rear end of one or both of the opposed pin recesses whereby, upon a fracture reaching the point beyond which unacceptable crimps would be made, the spring ejects the pin from the pin opening to provide a visual and tactile indication to the user of the failure.

In accordance with another aspect of the invention, the spring pin is modified so as to be displaced from its operative position relative to the spring pin opening in response to a fracture reaching the point outwardly of the pin opening, whereby the jawarms are jammed against relative displacement in the opening direction, whereby the failure is indicated to the operator. More particularly in this respect, the pin, which is cylindrical and has a given length and diameter prior to modification, can be modified by reducing the given length thereof. Upon a fracture and the ensuing deformation resulting in spreading of the pin recesses relative to one another, the stability of the pin in the opening is reduced and the spring biases the pin to a canted position in the opening and thus jams relative displacement of the jawarms in the direction to open the jaw recesses. Canting of the spring pin and thus jamming of the jaw arms can also be promoted by modifying the profile of the pin at the opposite ends thereof. In this respect, for example, the opposite ends of the pin which are initially manufactured to be defined by planar faces transverse to the pin axis, can be modified to provide conical or truncated conical profiles, or domed profiles. Another possible modification of the spring pin would be to reduce the given diameter thereof whereby, either alone or in combination with removal of material from the rear end of one or both of the opposed spring pin recesses, the spring would eject the pin from the opening upon the fracture reaching the reference point spaced outwardly from the pin recesses.

As described in greater detail hereinafter, the design for indicating failure in the foregoing manner is achieved by analyzing a jawarm to determine that the stress at the spring pin recess will result in a fracture of the arm from the recess to a point outwardly thereof and, preferably, the pivot pin opening, determining an acceptable amount of deformation of the arm along the fracture when the latter reaches the outer or reference point, and modifying one or the other, or both, the spring pin opening and spring pin for the latter to be displaced from its operation position when the acceptable amount of deformation is reached.

It is accordingly an outstanding object of the present invention to provide the user of a compression tool with an indication of failure of at least one of the jawarms thereof prior to operation of the compression tool which will result in the making of unacceptable, oversized crimps.

Another object is the provision of the jawarms of a jawset of a compression tool having a spring pin and spring pin opening therebetween with a structural modification of one or the other or both the spring pin opening and spring pin such that the spring pin will be ejected from the opening or will be displaced relative to the opening so as to jam the jaw arms against relative displacement in the direction to open the jaw recesses, thus to indicate a failure to the operator of the compression tool.

Still another object is the provision of a method of modifying one or the other or both the spring pin opening and spring pin in the jawset of a compression tool for indicating a failure in the jawset to the operator prior to an operation of the jaw set which will result in unacceptable, oversized crimps being made.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
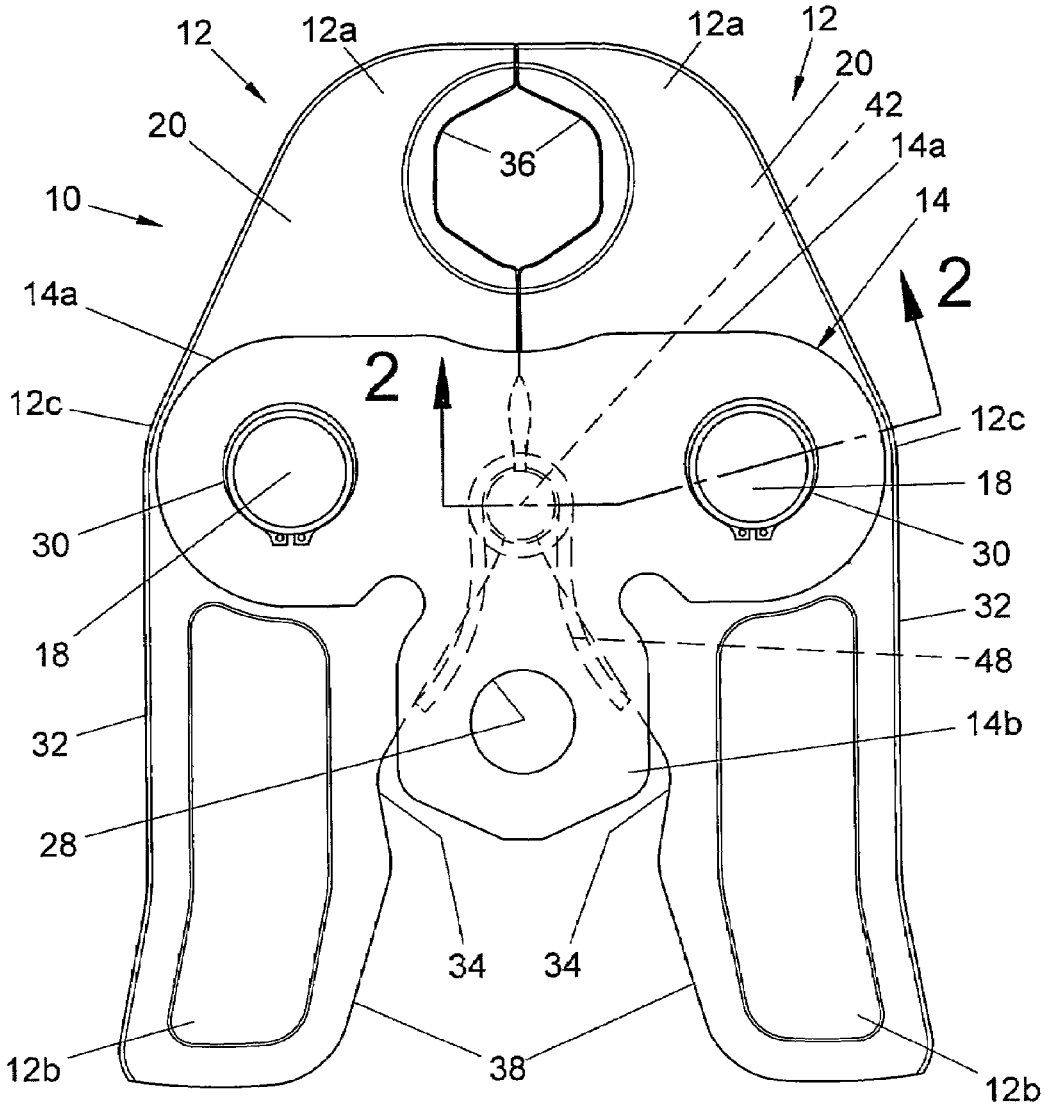
FIG. 1 is a plan view of a jawset including jawarms of the character to which the present invention is directed.
Figure 2:
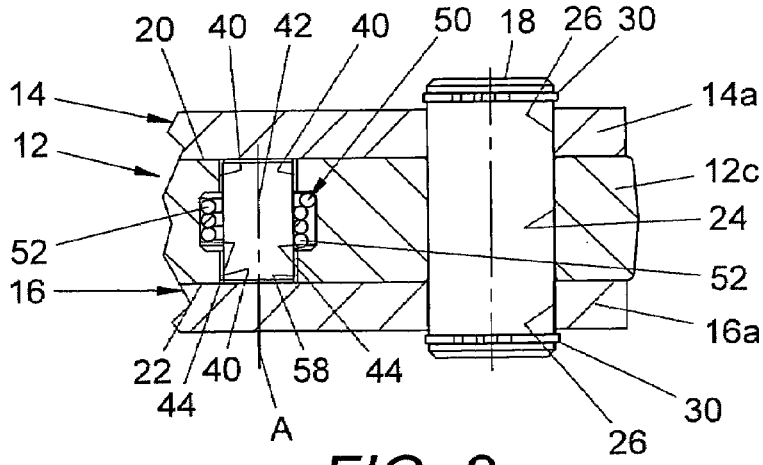
FIG. 2 is a sectional elevation view taken along line 2-2 in FIG. 1.
Figure 3:
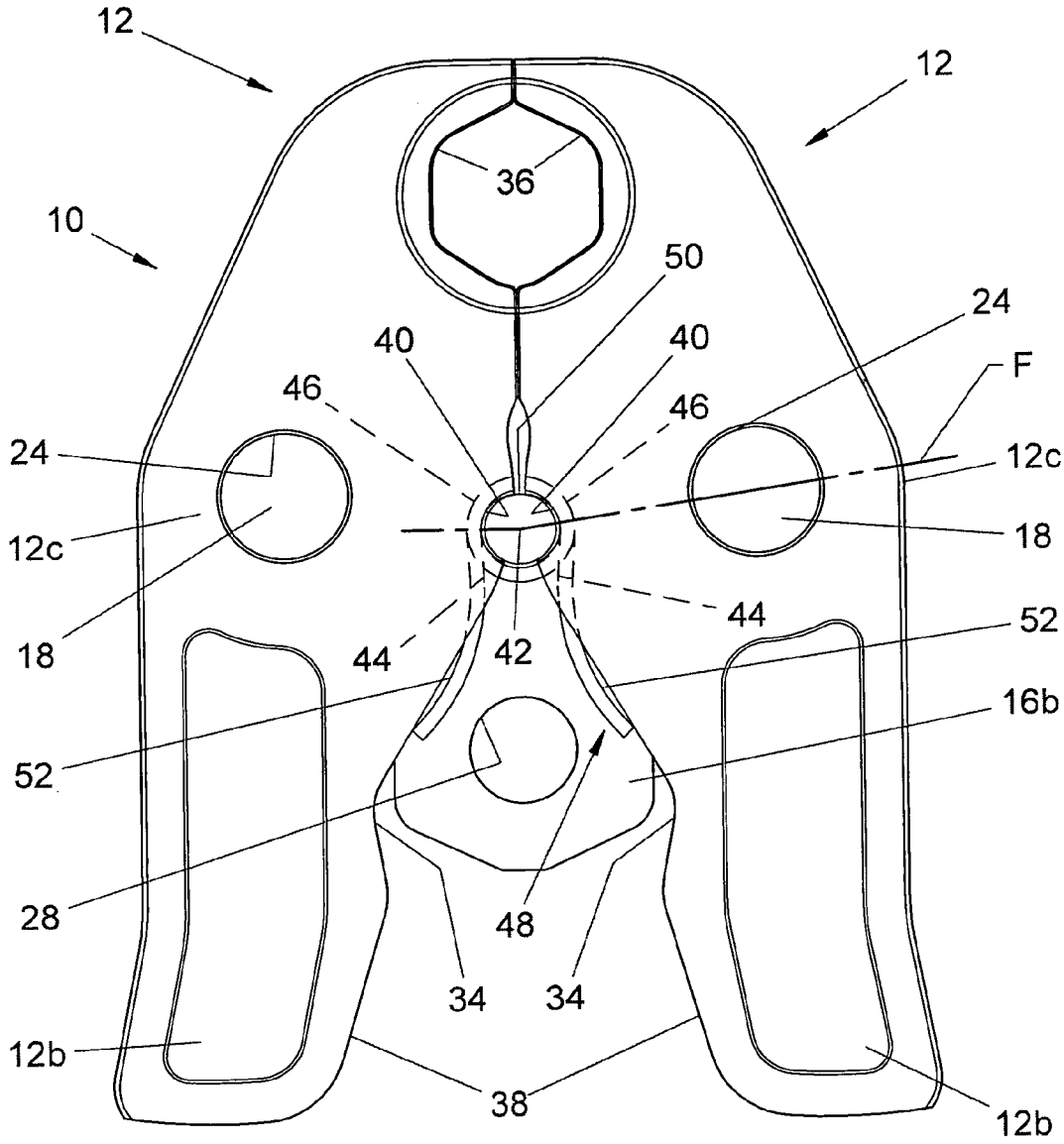
FIG. 3 is a plan view of the jawset shown in FIG. 1 with the top side plate removed and showing a typical line of fracture in a jawarm of the set.

Referring now in greater detail to the drawings, wherein the showings are for the purpose of illustrating preferred embodiments of the invention only, and not for the purpose of limiting the invention, FIGS. 1-3 illustrate a jawset 10 comprising a pair of jawarm members 12 mounted, in the orientation shown in FIGS. 1 and 2, between top and bottom side plates 14 and 16, respectively, by a corresponding pivot pin 18. Each of the jawarm members 12 has a top side 20 and a bottom side 22 and a pivot pin opening 24 therethrough for receiving the corresponding pin 18. Side plates 14 and 16 are generally T-shaped and include laterally opposite sides 14*a* and 16*a*, respectively, which are provided with aligned holes 26 for receiving the outer ends of the corresponding pin 18. Side plates 14 and 16 further include rear ends 14*b* and 16*b*, respectively, which are provided with aligned openings 28 therethrough which are adapted to receive a mounting pin by which the jawset is mounted on a drive unit in a well-known manner. The jawarm members and the side plates are retained in assembled relationship by spring clips 30 at the opposite ends of each of the pins 18.

Each of the jawarm members 12 has longitudinally opposite front and rear ends 12*a* and 12*b*, respectively, and each jawarm further includes laterally outer and inner edges 32 and 34, respectively, which are spaced from opening 24 and which extend forwardly and rearwardly of the opening. Inner edges 34 of the jawarm members provide laterally inwardly open opposed jaw recesses 36 at front ends 12*a* and forwardly of side plates 14 and 16, and laterally inwardly facing cam surfaces 38 at rear ends 12*b* and rearwardly of the rear ends of the side plates. Inner sides 34 of the jawarm are provided with opposed, inwardly open spring pin recesses 40 which together define a spring pin opening for a spring pin 42 having an axis A. For a 1-¼ inch jawset of the structure shown in the Amherd patent, the jawarms have a nominal thickness of 18 mm. The spring pin has a given nominal length of 18 mm, the spring pin recesses have a nominal radius of 5 mm, and the pin has a given nominal diameter of 10 mm, whereby the pin is axially and laterally captured between the side plates and pin recesses, as shown in FIG. 2. Inner edges 34 of the jawarm members are further provided with corresponding pin spring recesses 44 having arcuate front ends 46, and these recesses accommodate a torsion spring 48 having a closed end 50 which is coiled about pin 42 and extends across the front end of the pin in recess portions 46. Recesses 44 further accommodate spring legs 52 which extend rearwardly from the laterally opposite sides of closed end 50 and the along inner edge 34 of the corresponding jawarm.

In use, jawset 10 is mounted on a drive mechanism in a well-known manner by means of a pin which is attached to the drive mechanism and received in side plate openings 28. Ends 12*b* of the jawarm members are then manually displaced toward one another to pivot the arm members about pins 18 against the bias of spring 48 to open the jaw recesses 36 to receive a pipe and coupling to be compressed and, upon release of the jawarm members, spring 48 closes the jaw recesses about the pipe and coupling. The drive unit is then actuated for the cam rollers thereon to advance axially forwardly of the jawset and simultaneously engage against cam surfaces 38 to displace jawarm members 12 about pins 18 for jaw recesses 36 to compress the pipe and coupling together. Thereafter, the drive unit is actuated to withdraw the cam rollers and the jawarm members are again manually displaced against the bias of spring 48 to open the jaw recesses for removal of the jawset from the compressed pipe and coupling.

Figure 5:
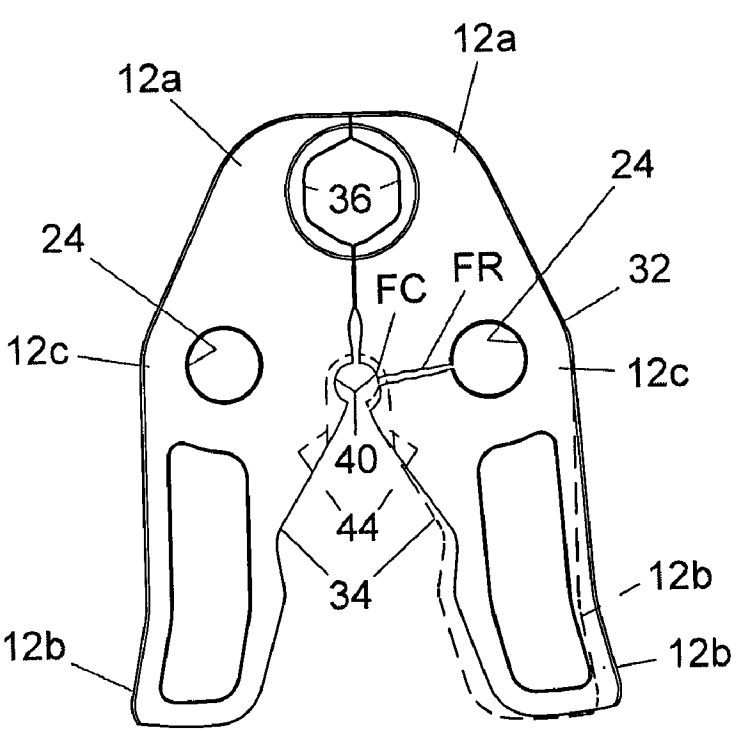
FIG. 5 is a plan view of the jawset shown in FIG. 4 and showing distortion of the jawarm upon a fracture initiated at the spring pin recess reaching the pivot pin opening.
Figure 4:
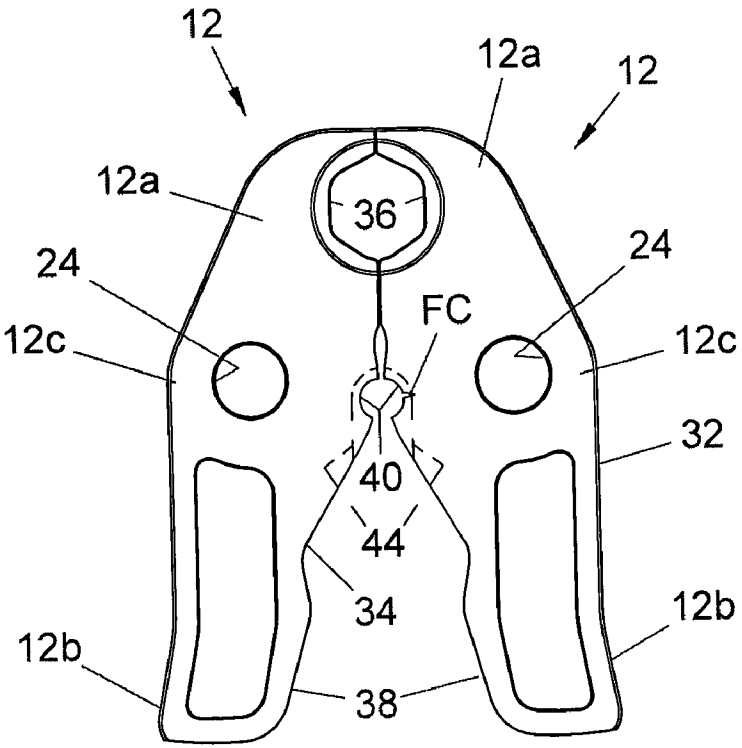
FIG. 4 is a plan view of the jawset shown in FIG. 1 with the side plates, spring pin and spring removed and showing a fatigue crack in the pin recess.

As mentioned hereinabove, 38 jawarms of the foregoing structure and of different sizes were tested in an effort to identify areas of failure, and 75% to 86% of the failures occurred in area F from a pin recess 40 to pivot pin opening 24. As further mentioned herein, and as will be appreciated from FIG. 1, a failure in this area of the jawarm is not visible to a user of the compression tool in that the entire area is covered by side plates 14 and 16. As seen in FIG. 4, the failure begins with a fatigue crack FC in a pin recess 40 and, as shown in FIG. 5 continues as a fracture FR to pivot pin opening 24. Once the fracture reaches pivot pin opening 24, continued operation of the compression tool deforms the fractured arm and spreads the fracture such that crimps made thereafter are unacceptable. More particularly in this respect, when the fracture FR reaches the pivot pin opening, the portion 12*c* of the jaw member between the pivot pin opening and the outer edge thereof provides a hinge effect, whereby laterally outward displacement of ends 12*b* of the jawarms by the cam rollers on the drive unit thereafter results in displacement of the portion of the jaw arm rearwardly of the fracture outwardly relative to the portion forwardly of the fracture and, therefore, a loss of the ability to make an acceptable crimp. When the fracture first reaches the pivot pin opening, deformation of the arm relative to area 12*c* does not laterally separate the spring pin recesses 40 to the extent necessary for the spring to eject the pin from the pin opening. Moreover, as mentioned herein, by the time the deformation is sufficient for the spring pin to be ejected, unacceptable, oversized crimps will have been made.

In accordance with the present invention, one or the other or both of the spring pin openings and spring pin are structurally modified such that a user of the compression tool is made aware of a failure in area F of a jaw arm when an acceptable amount of deformation of a jawarm is reached after the fracture reaches pivot pin opening 24. As will become apparent hereinafter, such a modification or modifications will result in the spring ejecting the spring pin rearwardly from the pin opening, or the spring displacing the spring pin relative to the opening so as to jam the jawarms against relative displacement in the direction to open the jaw recesses. More particularly with regard to designing for a given mode of indicating a failure, and with reference first to FIGS. 4 and 5 of the drawing, at least one of the jawarms 12 is analyzed to determine that the stress at the spring pin recess thereof will result in a failure being initiated at the spring pin recess by a fatigue crack FC in the recess. Such an analysis can be made by manual calculations or by strain gauges, for example. When the analysis is indicative of the fact that failure is likely to be initiated at the spring pin recess, such failure can be confirmed by physical testing. Such testing can be observed for purposes of seeing the initial fatigue crack by removing portions of one of the side plates so that the spring pin recesses and spring pin are visible.

After determining that the jawarm can or will fail from the area of the spring pin opening, the mode of failure is evaluated. In this respect, the failure is initiated at fatigue crack FC, and the arm is fractured along a line of fracture FR from the fatigue crack to a point spaced from the fatigue crack toward outer edge 32 of the jaw arm. Most likely, and preferably, the point to which the fracture extends is pivot pin opening 24, as shown in FIG. 5. When the fracture reaches the pivot pin opening, deformation of the broken jaw arm needs to be determined. In this respect, plastic or ductile deformation of end 12*b* of the jawarm about hinge area 12*c* is desired and not brittle separation of the jawarm parts in area 12*c*. The desired hinge effect is shown in FIG. 5 in which the position of end 12*b* prior to and after a fracture is shown by broken and solid lines, respectively. The stress in the material in area 12*c* of the jaw arm when making a crimp can be determined using FEA or hand calculations, or by making a crimp with a broken jaw set to see if deformation occurs. If the part does not deform, changes to the design can be made such as by lowering the yield strength of the material so as to assure ductile deformation of the parts.

Once it is determined that the desired deformation occurs, the amount of deformation that can occur before unacceptable crimps are made is then determined. This can be achieved, for example, by mimicking the fracture by a saw cut from the spring pin recess to the pivot pin opening in a jawarm and then using the jawarm in a jawset to make one or more crimps on a fitting. The fracture will spread during succeeding crimping operations, and the amount of acceptable deformation occurs just prior to the attempted crimping operation in which the force required to achieve an acceptable crimp is not obtained. While it is preferred to determine the amount of deformation through the use of jawarm parts, modeling of the fracture as a cut from the spring pin recess to the pivot pin hole can be done for this purpose. A difficulty in connection therewith is determining the position of the jaw recesses over a fitting being crimped in that the latter position depends on the amount of force that the rear end of the jawarm can transmit to the fitting. The latter can be determined using the yield strength of the material of the jawarm and converting through the equivalent force at the fitting and then comparing the latter to a force vs. displacement curve for the fitting. The position of the jaw recess is determined when the force required to crimp the fitting exceeds the force required to reach the yield strength of the jawarm material.

Figure 6:
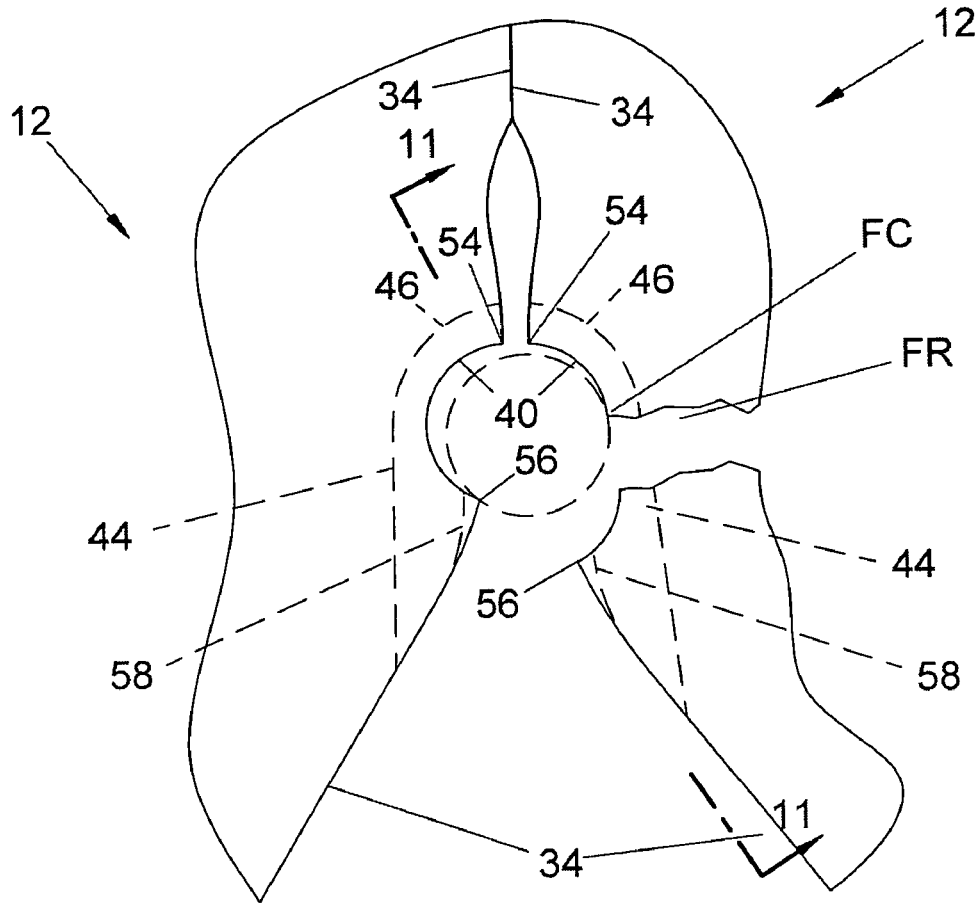
FIG. 6 is an enlarged plan view showing distortion of the spring pin recesses and displacement of the spring pin relative thereto following a fracture.
Figure 7:
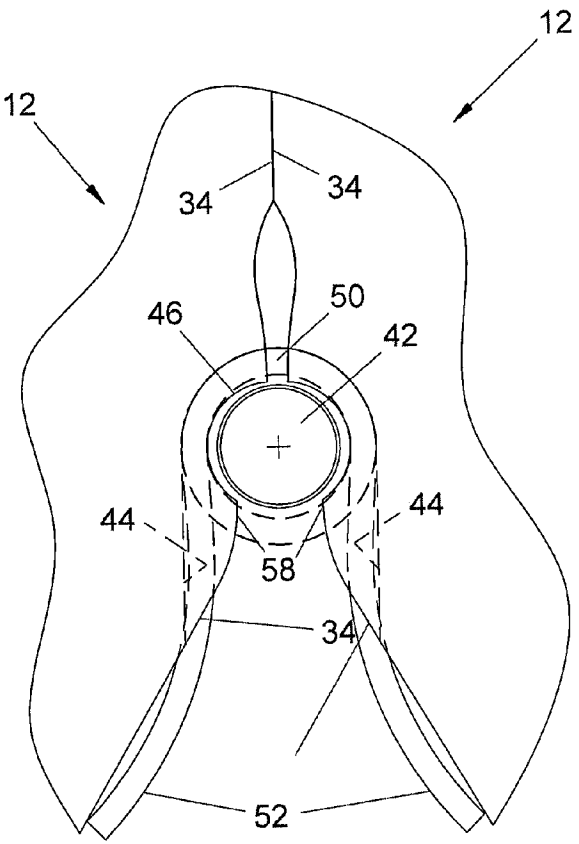
FIG. 7 is an enlarged plan view of the spring pin recesses after modification of the pin opening.

Once the amount of acceptable deformation is determined, a part layout can be made to determine the modification of the spring pin opening and/or the spring pin necessary to achieve either ejection of the spring pin from the pin opening when the point of acceptable deformation is reached, or canting of the pin in the pin opening by the torsion spring at the latter point for the pin to jam the jaw arms against displacement in the direction to open the jaw recesses. The layout is done with one broken and deformed jaw member and one unbroken jaw member, as shown in FIGS. 5 and 6. With reference in particular to FIG. 6, spring pin recesses 40 have opposed front ends 54 and opposed rear ends 56, and it is the distance between rear ends 56 at the point where the acceptable deformation of the jaw arm is reached which provides the basis for modifying one or the other or both the spring pin opening and spring pin for ejecting the spring pin or causing jamming of the jaw arms as set forth hereinabove. Assuming, with respect to FIG. 6, that it is decided to modify the spring pin opening to achieve spring pin ejection upon failure of the jaw set, material is removed, such as by grinding, from each of the rear ends 56 laterally outwardly to a location identified by broken lines 58, the distance between which will allow for ejection of the spring pin rearwardly from the pin opening upon the acceptable amount of deformation being reached. Preferably, material is removed from the rear ends of both of the pin recesses to optimize stability of the spring pin in the pin opening prior to failure. Further, while material can be removed from the rear ends of the pin recesses together with reducing the given diameter of the pin to provide for ejection of the latter, or the pin alone can be reduced in diameter to achieve ejection, it is preferred to maintain the given diameter of the pin, again to stabilize the latter during operation of the jaw set prior to failure. Once the amount of material to be removed has been determined, two unbroken jaw arms with the material removed therefrom are laid out, as shown in FIG. 7, to confirm that the spring pin will be retained in the pin opening prior to a failure.

Figure 8:
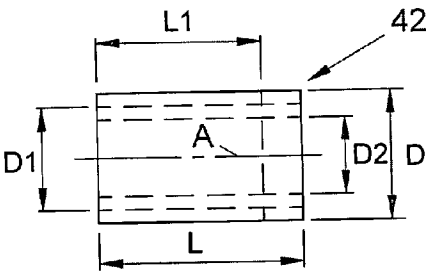
FIGS. 8, 9 and 10 illustrate modifications of the spring pin in accordance with the invention; and, FIG. 11 is a cross sectional view along line 11-11 in FIG. 6 and illustrates a modified spring pin in a canted position in the pin opening.

With reference to FIG. 8 of the drawing, spring pin 42 as manufactured for use in the jawset disclosed, has a given length L between side plates 14 and 16 and a given diameter D. As mentioned above, in connection with modification of the spring pin opening, given diameter D of the pin can be reduced, as indicated by the dimension D1, in conjunction with the removal of material from the rear ends of the spring pin recesses to achieve spring ejection upon failure. It is also possible to reduce the given diameter of the pin to give a smaller diameter than D1, as indicated by the dimension D2, to provide for pin ejection from the pin opening when a failure occurs and without the removal of material from the rear ends of the pin recesses. Again, however, it is preferred to maintain or closely maintain the given pin diameter to optimize stability of the latter in the pin opening during use of the jaw set and prior to a failure.

Figure 9:
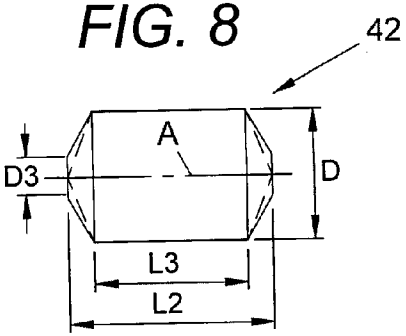
Figure 10:
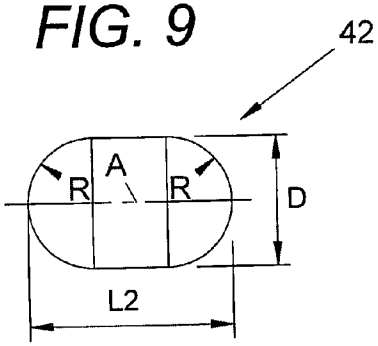
Figure 11:
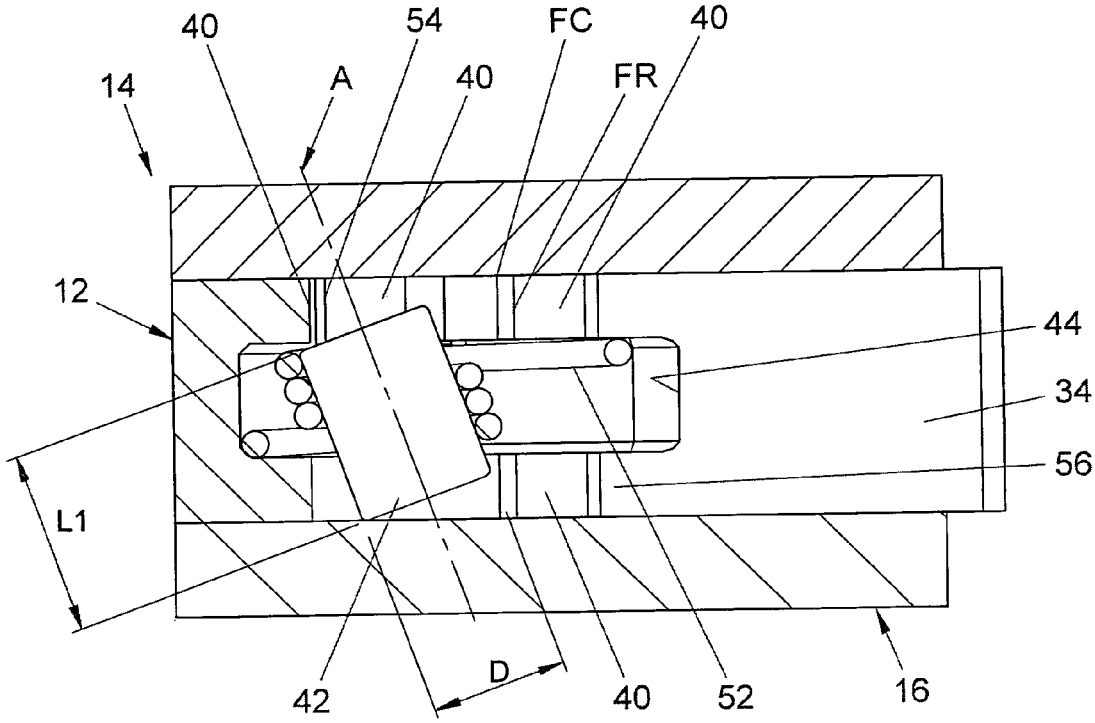

FIGS. 8, 9 and 10 illustrate modifications of the spring pin by which, upon the deformation of the jaw arm reaching the acceptable amount following a fracture results in the spring biasing the pin to a canted position in the pin opening and in which the pin jams the jaws against relative pivotal displacement in the direction to open the jaw recesses, as shown in FIG. 11. Such canting and jamming of the jaw arms can be achieved by shortening the given length of the pin to a length L1 as shown in FIGS. 8 and 11. The canting and jamming can be further promoted by modifying the opposite ends of the pin, as shown in FIGS. 9 and 10. More particularly in this respect, the opposite ends of the spring pin which, in the given profile thereof, are planar faces transverse to the pin axis, are either provided with conical ends as shown by broken lines in FIG. 9, or truncated conical ends, as shown by solid lines in FIG. 9, or with domed ends as shown in FIG. 10. Preferably, the diameter of the pins in FIGS. 9 and 10 is the given diameter D, and the domed ends are spherical, having a radius of curvature corresponding to the diameter of the pin. With respect to pin 42 described herein with reference to FIGS. 1-3 as having a given length of 18 mm and a given diameter of 10 mm, the shortened length L1 is 13.5 mm. With regard to the truncated conical end configuration shown in FIG. 9, length L2 is 17.8 mm, length L3 is 13.5 mm, and diameter D3 is 2 mm. The length L2 in the conical, truncated conical and domed end configurations is slightly less than the given length to provide sufficient clearance between the side plates and spring pin for the latter to be canted in the spring pin opening. Further, in the conical and truncated conical configurations, the edges at the ends of length L3 can be chamfered.

While considerable emphasis has been placed herein on the structures and structural interrelationships between the component parts of the preferred embodiments, it will be appreciated that other embodiments can be made and that many changes can be made in the preferred embodiments without departing from the principles of the invention. In this respect, for example, the biasing spring can be hairpin shaped with the closed end thereof extending across the forward end of the spring pin. Further, if the fracture in a particular jaw arm design extends from the spring pin recess to a point forwardly or rearwardly of the pivot pin opening, it will be appreciated that the jaw arm will deform relative to the material between the end point of the fracture and the outer edge of the jaw arm, whereby modification of one or the other or both the pin opening and spring pin can be determined for achieving ejection of the spring pin or canting thereof in the spring pin opening to indicate a failure in accordance with the invention. Still further, it will be appreciated that jaw arms of compression tools of the character to which the invention is directed which do not have a spring pin and spring pin opening can be modified in this respect so as to enable designing the jaw arm for indicating a failure in accordance with the invention. Furthermore, a modified spring pin can be a modification of the original pin or can be manufactured with the modified profile. Accordingly, it is to be distinctly understood that the foregoing descriptive matter is to be interpreted merely as illustrative of the invention and not as a limitation and that it is intended to include other embodiments and all modifications of the preferred embodiments insofar as they come within the scope of the appended claims or the equivalents thereof.

Having thus described the invention, it is so claimed:

1. A method of designing and modifying a compression tool jawset to displace a jawset and spring pin from an operative position thereof upon failure of a jawarm of the jawset at the spring pin location, the jawset comprising a pair of side plates, a pair of jawarms having pivot pin openings receiving pivot pins between said plates, each jawarm having inner and outer edges laterally spaced from and extending forwardly and rearwardly of the corresponding pivot pin opening, said inner edges including laterally inwardly open opposed jaw recesses forwardly of the pivot pin openings and inwardly facing cam surfaces rearwardly of the openings, the jawarms during use of the compression tool being pivotal about the pivot pins in response to forces laterally outwardly against the cam surfaces to displace the jaw recesses laterally inwardly in a closing direction to compress an object therebetween, whereby an area of each jawarm between the corresponding pivot pin opening and inner edge thereof and between the cam surface and jaw recess thereof is under tension, a spring pin opening defined by opposed pin recesses, each in said area of the corresponding jawarm, said pin recesses having opposed front ends and opposed rear ends, a spring pin in said opening and having a given length and a given diameter, and a spring having a forward end extending across said pin and legs extending rearwardly each along the inner edge of a different one of the jawarms, said spring pin opening supporting said spring pin in an operative position and said spring biasing said jaw recesses in the closing direction, said method comprising:

(a) analyzing at least one of the jawarms to determine that the stress at the pin recess thereof will result in a fatigue crack initiated at the pin recess during use and fracture of the jawarm from the fatigue crack to a point spaced therefrom toward the outer edge of the jawarm, (b) determining the amount of acceptable deformation of the jawarm along the fracture when the fracture reaches said point, and (c) modifying at least one of the spring pin opening and the spring pin in said jawset for the spring to displace the spring pin from the operative position thereof when said acceptable amount of deformation is reached.

2. The method of claim 1, wherein said spring pin is modified.

3. The method of claim 2, wherein said spring pin is modified by reducing said given length thereof.

4. The method according to claim 2, wherein said spring pin has an axis and axially opposite ends having planar surfaces transverse to said axis, and said spring pin is modified by providing each of the opposite ends thereof with one of a conical profile and a domed profile.

5. The method according to claim 4, wherein the opposite ends are provided with a truncated conical profile.

6. The method according to claim 4, wherein the opposite ends are provided with a domed profile.

7. The method according to claim 6, wherein the domed profile has a radius corresponding to the radius of said given diameter.

8. The method according to claim 2, wherein said spring pin is modified by reducing said given diameter thereof.

9. The method according to claim 1, wherein said spring pin opening is modified.

10. The method according to claim 9, wherein said spring pin opening is modified by removing material from the rear end of the pin recess of at least one of the jawarms.

11. The method according to claim 10, wherein material is removed from the rear end of each of the pin recesses.

12. The method according to claim 1, and after step (a) and before step (b) determining that deformation will be relative to the material of the jawarm between said point and the outer edge of the jawarm.

13. In a compression tool including a pair of parallel spaced apart side plates having front and rear ends and laterally opposite sides, aligned holes through said plates at each of said opposite sides, a pair of jawarms between said plates, each said jawarm having an opening therethrough aligned with the holes through a different one of said opposite sides, each said jawarm being pivotally mounted between said plates by a pivot pin extending through the opening therethrough and the corresponding aligned holes through said side plates, each said jawarm having inner and outer edges laterally spaced from the opening therethrough and extending forwardly and rearwardly of the opening therethrough, said inner edges providing laterally inwardly open opposed jaw recesses forwardly of said front ends of said side plates and laterally inwardly facing cam surfaces rearwardly of said rear ends of said side plates, the jawarms during use of the compression tool being pivoted about said pivot pins in response to forces laterally outwardly against said cam surfaces to displace said jaw recesses laterally inwardly in a closing direction to compress an object therebetween, whereby an area of each jawarm between the opening and inner edge thereof and between the cam surface and jaw recess thereof is under tension, a spring pin opening defined by opposed arcuate pin recesses in said area of each jawarm, said arcuate recesses having opposed front ends and opposed rear ends with respect to said front and rear ends of said side plates, a spring pin in said opening and having an axial position between and transverse to said side plates, a spring having a forward end forwardly of and extending across said spring pin and having legs each extending rearwardly of said forward end thereof along the inner edge of a different one of the jawarms, said spring biasing said jaw recesses in said closing direction and biasing said spring pin rearwardly of said spring pin opening, said opposed rear ends of said arcuate recesses being spaced apart a given distance, and said spring pin having a given profile, the improvement comprising: at least one of said spring pin and said spring pin opening being modified by having material removed therefrom to, respectively, increase said given distance and modify said given profile causing, substantially immediately in response to a fracture of at least one of said jawarms outwardly from the corresponding arcuate recess toward the outer edge of the jawarm, at least one of said spring pin being ejected from the spring pin opening and said jawarms jamming.

14. The improvement according to claim 13, wherein the rear end of at least one of said arcuate recesses has material removed therefrom to increase said given distance.

15. The improvement according to claim 13, wherein the rear ends of each of said arcuate recesses has material removed therefrom to increase said given distance.

16. The improvement of claim 13, wherein said spring pin profile is modified by reducing said given length thereof.

17. The improvement according to claim 13, wherein said given profile of said spring pin includes said spring pin having an axis and axially opposite ends being modified by providing each of the opposite ends thereof with one of a conical profile and a domed profile.

18. The improvement according to claim 17, wherein the opposite ends of the pin are provided with a truncated conical profile.

19. The improvement according to claim 17, wherein the opposite ends of the pin are provided with a domed profile.

20. The improvement according to claim 19, wherein the domed profile has a radius corresponding to the radius of said given diameter.

21. The improvement according to claim 13, wherein said given profile of said spring pin includes said spring pin having a given diameter and said spring pin profile is modified by reducing said given diameter thereof.

22. A method of modifying a compression tool jawset for a jawset biasing spring and spring pin thereof to be displaced from an operative position thereof upon failure of a jawarm of the jawset at a spring pin location, the jawset comprising a pair of side plates, a pair of jawarms supported between the plates for pivotal movement relative thereto about a corresponding pivot axis, each jawarm having inner and outer edges laterally spaced from and extending forwardly and rearwardly of the corresponding pivot axis, said inner edges including laterally inwardly open opposed jaw recesses forwardly of the pivot axes and inwardly facing cam surfaces rearwardly of the pivot axes, the jawarms during use of the compression tool being pivotal about the pivot axes in response to forces laterally outwardly against the cam surfaces to displace the jaw recesses laterally inwardly in a closing direction to compress an object therebetween, whereby an area of each jawarm between the corresponding pivot axis and inner edge thereof and between the cam surface and jaw recess thereof is under tension, a spring pin opening defined by opposed pin recesses, each in said area of the corresponding jawarm, said pin recesses having opposed front ends and opposed rear ends, a spring pin in said opening, and having a given length and a given diameter, and a spring having a forward end extending across said pin and legs extending rearwardly each along the inner edge of a different one of the jawarms, said spring pin opening supporting said spring pin in an operative position and said spring biasing said jaw recesses in the closing direction, said method comprising:

modifying at least one of the spring pin opening and the spring pin, and positioning the spring pin in the spring pin opening so that, substantially immediately upon a failure of a jawarm resulting in a fracture of the arm outwardly from the corresponding pin recess toward the outer edge of the arm, at least one of said spring pin is ejected from said operative position thereof and said jawarms are jammed preventing said pivotal movement thereof.

23. The method of claim 22, wherein said spring pin is modified by reducing said given length thereof.

24. The method according to claim 22, wherein said spring pin has an axis and axially opposite ends having planar surfaces transverse to said axis, and said spring pin is modified by providing each of the opposite ends thereof with one of a conical profile and a domed profile.

25. The method according to claim 24, wherein the opposite ends are provided with a truncated conical profile.

26. The method according to claim 24, wherein the opposite ends are provided with a domed profile.

27. The method according to claim 26, wherein the domed profile has a radius corresponding to the radius of said given diameter.

28. The method according to claim 22, wherein said spring pin is modified by reducing said given diameter thereof.

29. The method according to claim 22, wherein said spring pin opening is modified.

30. The method according to claim 29, wherein said spring pin opening is modified by removing material from the rear end of the pin recess of at least one of the jawarms.

31. The method according to claim 30, wherein material is removed from the rear end of each of the pin recesses.

32. A compression tool comprising:

a pair of parallel spaced apart side plates having front and rear ends and laterally opposite sides;

aligned holes through said plates at each of said opposite sides;

a pair of jawarms between said plates, each said jawarm having an opening therethrough aligned with the holes through a different one of said opposite sides;

a pivot pin, each said jawarm being pivotally mounted between said plates by the pivot pin extending through the opening therethrough and the corresponding aligned holes through said side plates;

each said jawarm having inner and outer edges laterally spaced from the opening therethrough and extending forwardly and rearwardly of the opening therethrough, said inner edges providing laterally inwardly open opposed jaw recesses forwardly of said front ends of said side plates and laterally inwardly facing cam surfaces rearwardly of said rear ends of said side plates;

the jawarms during use of the compression tool being pivoted about said pivot pins in response to forces laterally outwardly against said cam surfaces to displace said jaw recesses laterally inwardly in a closing direction to compress an associated object therebetween, whereby an area of each jawarm between the opening and inner edge thereof and between the cam surface and jaw recess thereof is under tension;

a spring pin opening defined by opposed arcuate pin recesses in said area of each jawarm, said arcuate recesses having opposed front ends and opposed rear with respect to said front and rear ends of said side plates;

a spring pin in said spring pin opening and having an axial position between and transverse to said side plates;

a spring having a forward end forwardly of and extending across said spring pin and having legs each extending rearwardly of said forward end thereof along the inner edge of a different one of the jawarms, said spring biasing said jaw recesses in said closing direction and biasing said spring pin rearwardly of said spring pin opening, said opposed rear ends of said arcuate recesses being spaced apart a first distance, and said spring pin having a first profile, at least one of the first profile of said spring pin and the first distance of said spring pin opening being sized with a selected profile so that at least one of said spring pin is displaced from said spring pin opening and said jawarms are caused to jam substantially immediately in response to a fracture of at least one of said jawarms outwardly from the corresponding arcuate recess toward the outer edge of the jawarm, to indicate a failure of the compression tool to a user thereof substantially immediately after said fracture and prior to making oversized crimps of said associated object between said jaw recesses during said use of the compression tool.

33. The compression tool according to claim 32, wherein said first profile of said spring pin includes said spring pin having an axis and axially opposite ends being modified by providing each of the opposite ends thereof with one of a conical profile and a domed profile.

34. The compression tool according to claim 33, wherein the opposite ends of the spring pin are provided with a truncated conical profile.

35. The compression tool according to claim 33, wherein the opposite ends of the spring pin are provided with a domed profile.

36. The compression tool according to claim 35, wherein the domed profile has a radius corresponding to the radius of said given diameter.

* * * * *